United States Patent [19]

Coon et al.

[11] Patent Number: 4,523,651

[45] Date of Patent: Jun. 18, 1985

[54] COAL AUGER GUIDANCE SYSTEM

[75] Inventors: Julian B. Coon; Bobby J. Thomas, both of Ponca City, Okla.

[73] Assignee: Conoco Inc., Ponca City, Okla.

[21] Appl. No.: 104,627

[22] Filed: Dec. 17, 1979

[51] Int. Cl.[3] ..... E21B 47/12; E21C 35/08

[52] U.S. Cl. ..... 175/45; 299/1; 175/61; 181/108

[58] Field of Search ..... 299/1, 30; 175/45, 61, 175/108; 181/108, 1.11, 112, 104, 106; 254/134.4; 104/138 G, 138 R

[56] References Cited

U.S. PATENT DOCUMENTS

| | | | |
|---|---|---|---|
| 3,578,807 | 5/1971 | Barrett | 299/1 |
| 3,853,185 | 12/1974 | Dahl | 175/45 |
| 3,891,050 | 6/1975 | Kirkpatrick | 181/104 |
| 3,978,939 | 9/1976 | Troullier | 181/104 |
| 4,006,359 | 2/1977 | Sullins | 104/138 G |
| 4,072,349 | 2/1978 | Hartley | 299/1 |

*Primary Examiner*—William F. Pate, III

*Attorney, Agent, or Firm*—William J. Miller

[57] ABSTRACT

A method and apparatus for maintaining a second elongated hole axis substantially parallel to a previously bored horizontal hole axis which entails inserting a seismic signal generating apparatus into one hole and a seismic signal receiving apparatus into the other hole. The seismic receiver includes apparatus for moving it along the axis, for maintaining the receiver substantially parallel to the gravitational bottom of the hole, and for moving the receiver a predetermined distance from the borehole wall which is adjacent the borehole containing the seismic signal generating apparatus. Apparatus for observing the detected signal is located outside the borehole.

9 Claims, 6 Drawing Figures

COAL AUGER GUIDANCE SYSTEM

BRIEF DESCRIPTION OF THE PRIOR ART

In the mining of coal or other minerals, when the seam is thin, normal tunnel or room and pillar mining or long wall techniques cannot be employed economically; however, there is one technique which can be used in the removal of the minerals. This system bores or augers long parallel holes in the mineral seam leaving a wall between each parallel hole to prevent the hole from collapsing on the augering equipment. Such a method is clearly illustrated in U.S. Pat. No. 4,036,529. The most difficult problem, however, is maintaining the elongated hole parallel. U.S. Pat. Nos. 3,907,045; 3,853,185; and 3,578,807 illustrate electrical methods for maintaining the hole parallel. U.S. Pat. No. 3,285,350 illustrates a system where a signal is generated by a drilling apparatus and a detector receives the noise generated during drilling and directs the drilling to connect two boreholes.

BRIEF DESCRIPTION OF THE INVENTION

This invention describes an apparatus and method for drilling a borehole parallel to a previously drilled borehole by constructing a cart having rear wheels and a forward steerable wheel with a detector mount attached to the cart. The detector mount will move the detector perpendicular to the axis of the borehole and adjacent the wall of the borehole. The detector includes apparatus for precisely orienting the detector a fixed distance from the wall to maintain a constant coupling which can be repeated each time the detector is moved.

Apparatus is provided in the cart to keep the detector mounting platform always parallel to a plane which passes along the gravitational bottom of the borehole wall. Observation equipment is positioned outside the borehole to properly determine the borehole axial position of the cart and the detector reading for determining the distance between boreholes. A seismic signal generator is positioned in the other borehole to create a signal which can be received by the detector.

DETAILED DESCRIPTION OF THE INVENTION

The same reference numbers will be used throughout the specification for the same elements.

Figures 1, 6:
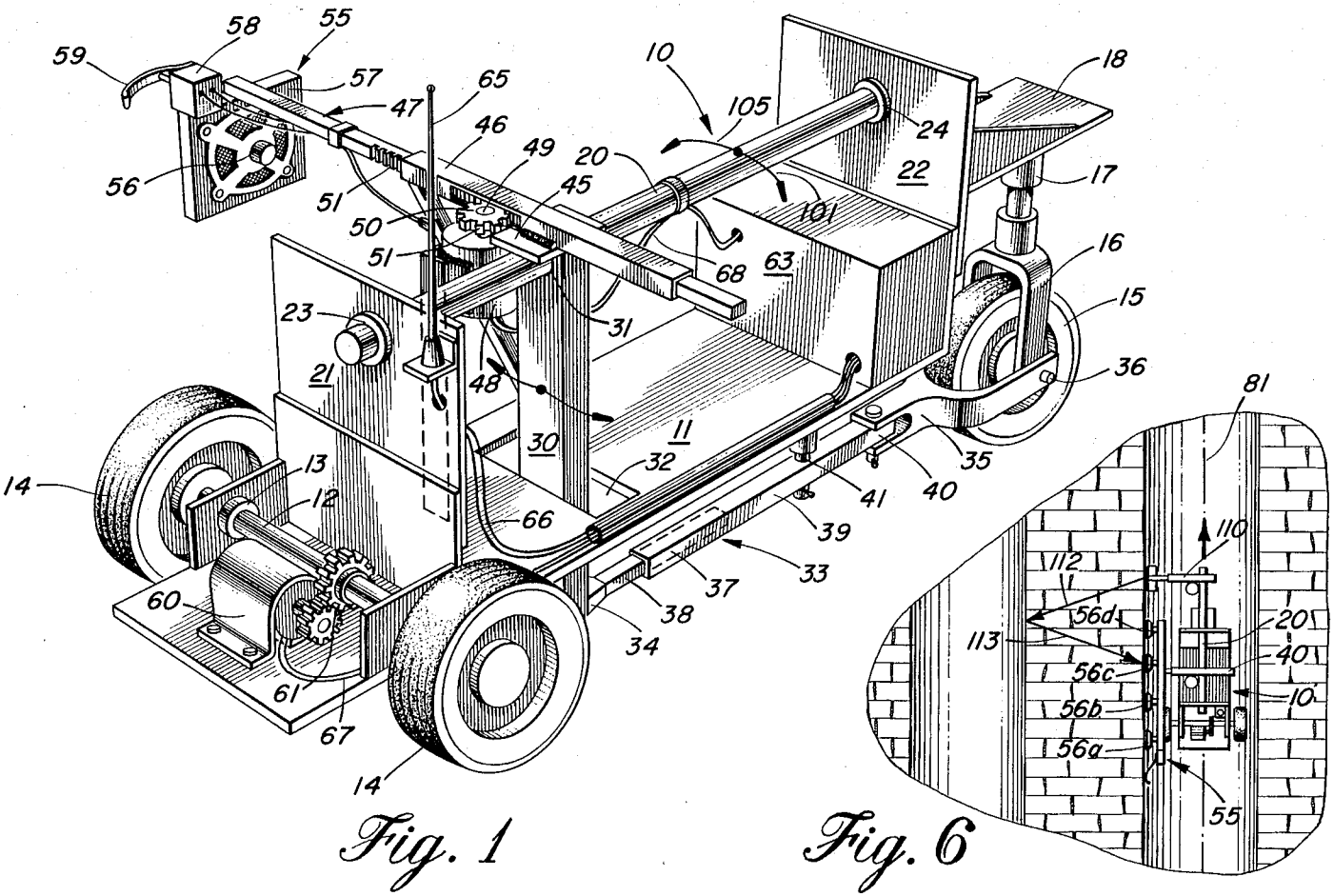
FIG. 1 is an isometric view of the detector cart.
FIG. 6 is a modification of the apparatus illustrated in the previous figures.
Figure 2:
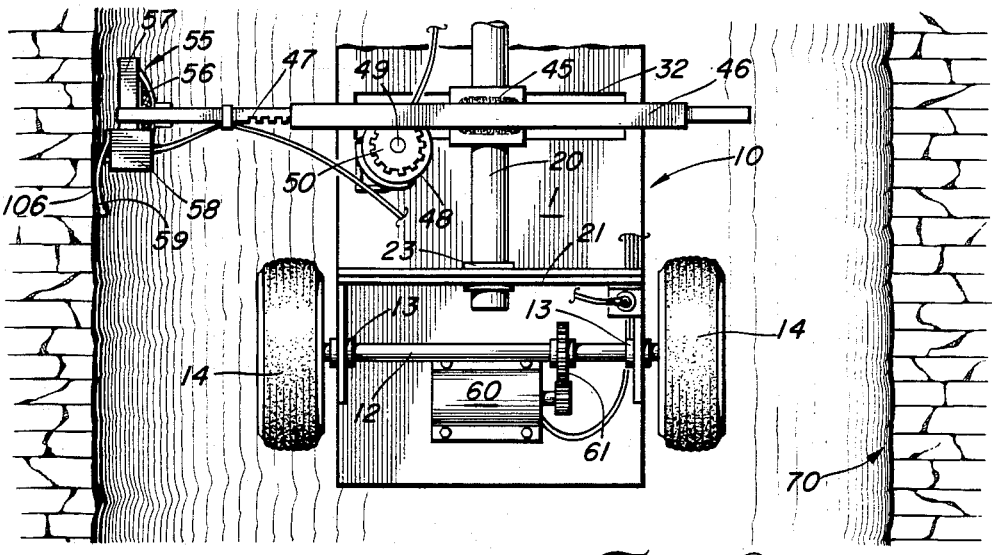
FIG. 2 is a partial top view of the detector cart illustrating the operation of the detector unit.
Figure 3:
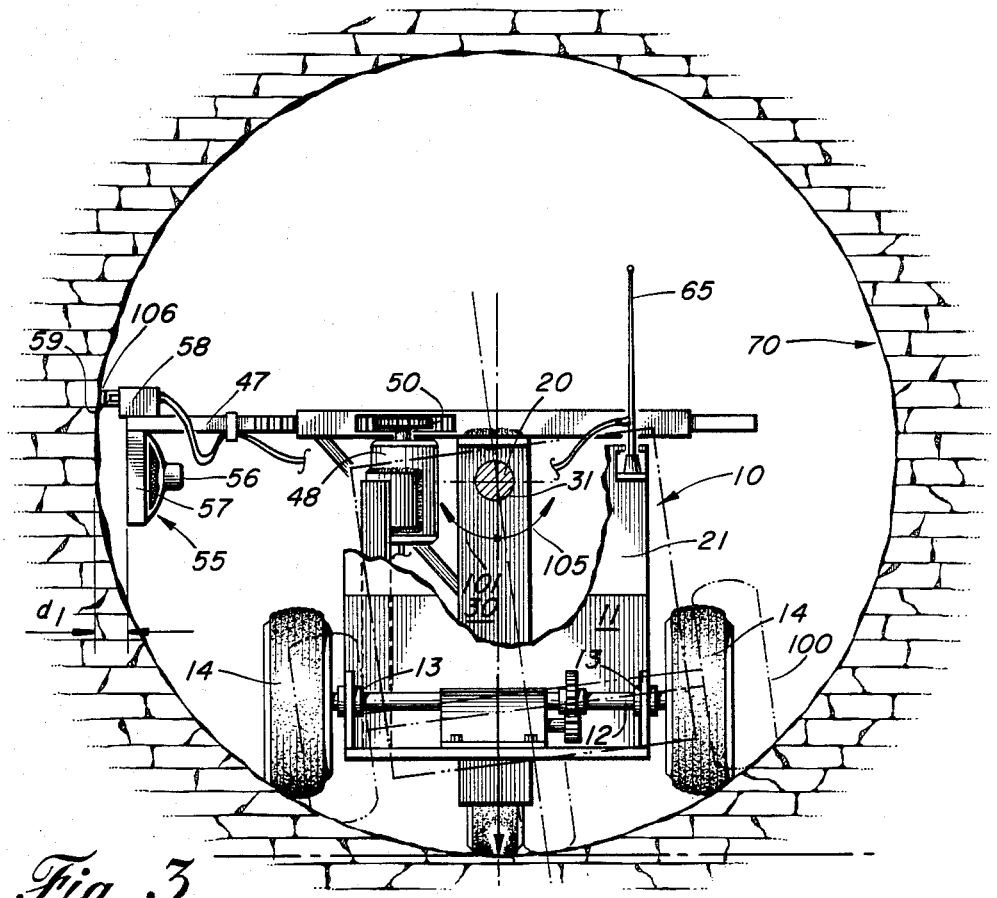
FIG. 3 is an end view of the detector cart.

Referring to all of the drawings but particularly to FIGS. 1, 2, and 3, a detector cart or vehicle generally referred to by arrow 10 is illustrated which has a main frame 11 which has a rear axle 12 horizontally journaled to frame 11. Bearings 13 rotatably affix the axle 12 to frame 11 and are preferably of the sealed type to prevent dust or water from reaching the bearing surfaces. A pair of wheels 14 is rigidly attached to axle 12 in the usual manner. A front wheel 15 is rotatably attached to a yoke 16 which in turn is attached on a pivot 17 to a frame extension 18.

A steering and detector leveling shaft 20 is journaled in frame uprights 21 and 22 by means of bearings 23 and 24, respectively. A mass 30 is rigidly attached to steering shaft 20 at 31 and extends through an opening 32 in frame 10. A linkage generally referred to by arrow 33 is attached to mass 30 at 34 and terminates in a yoke 35 which is attached at an axle 36 for wheel 15. Linkage 33 includes a sliding portion 37 between linkage sections 38 and 39 to accommodate changes in the length of linkage 33 and a pivot portion 40 coupling the end of linkage section 38 to yoke 35. Linkage section 39 is also attached by a pivot 41 to main frame 11.

The detector apparatus comprises a base 45 attached to shaft 20 with a square tubular attachment affixed thereto. A rack or arm 47 is slidably supported by tube 46 and operated by a motor 48 which is attached to weight or mass 30. A motor shaft 49 has a gear 50 which is rigidly attached to shaft 49 and engages rack 47 through cooperating teeth 51. A detector unit 55 contains a detector 56 attached to rack 47 through a mount 57. Also attached to mount 57 is a switch 58 having a pivotally mounted switch arm 59 which engages the borehole and will be explained in a subsequent portion of the application.

A drive motor 60 has its power connected through gears 61 to shaft 12 to propel cart 10 along the axis of the borehole. Motors 60 and 48 obtain their driving power from a battery (not shown) in box 63. Signals can be transmitted or received on antenna 65 coupled to a receiver or transmitter through wire 66 to electronics (not shown) contained in box 63. Wires 67 and 68 couple motors 60 and 48 to controls (not shown) in box 63 and to a source of power as previously explained. In its obvious, of course, that a cable could connect the detector cart 10 with an operator outside the borehole thus eliminating the battery and control radio.

OPERATION

Figure 4:
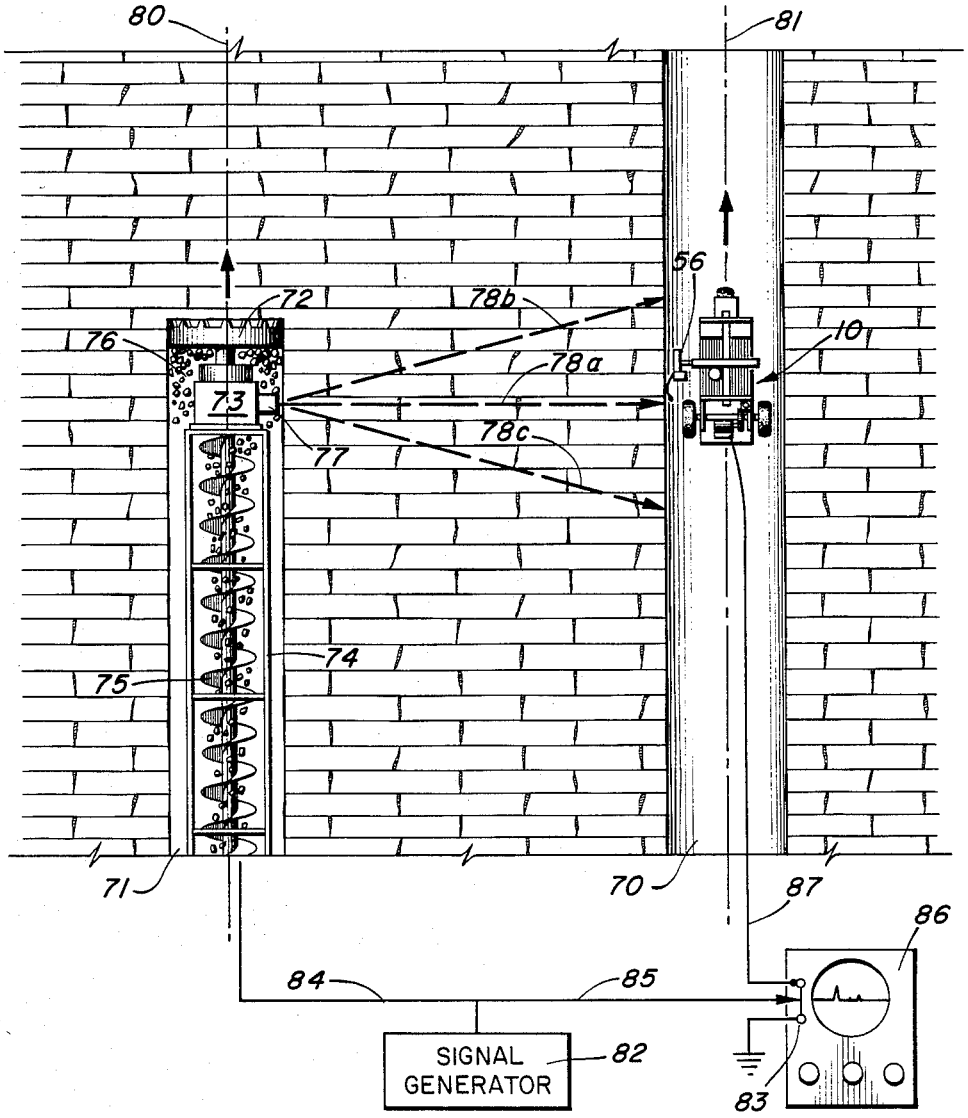
FIG. 4 is a cross-sectional view of two horizontal holes illustrating the operation of the seismic signal generator and cart position.

The general operation is best described with reference to FIG. 4 where an auger has previously bored a hole 70. A hole 71 is in the process of being bored by an augering cutter head 72 which may incude a gear box 73 which is attached to a support system 74. An auger 75, when rotating, removes the material 76 from hole 71. A sonic generator or seismic source 77 generates sound along rays 78*a*, 78*b*, and 78*c*, for example, to adjacent hole 70. One of the objects of this invention is to maintain the axis 80 substantially parallel to axis 81.

In normal use, the sonic signal is generated, in the preferred embodiment, by a source of power such as a signal generator 82 coupled to the seismic source and input 83 of oscilloscope 86 with wires 84 and 85, respectively. A suitable isolation means (not shown) may be employed between wire 85 and wire 87, if necessary.

Auger head 72, which is boring hole 71, must have an axis 80 substantially parallel to axis 81. When cutting head 73 reaches a predetermined depth, the parallelism of the two axes 80 and 81 must be checked. To accommodate the check, cart 10 is moved into hole 70 to a position as nearly opposite ray 78*a* as possible. Signal generator 82 generates a signal down wire 84 to seismic source 77 which generates a signal into the ground toward borehole 70 along rays 78*a*, 78*b*, and 78*c*, for example. Detector 56 (the actual operation of which will be described in a subsequent portion of the application) picks up the signal and transmits it down wire 87 to scope 86.

Figure 5:
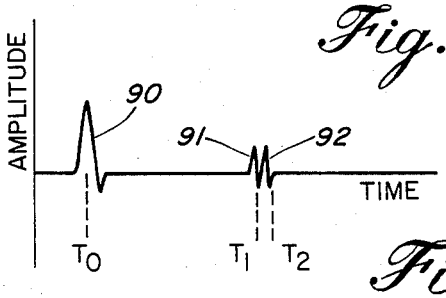
FIG. 5 is a chart illustrating time versus amplitude of pulses received by the detector apparatus.

Referring to FIG. 5 a representation of the scope trace is illustrated. The first pulse 90 represents the signal from wire 85 which is the transmitted signal from generator 82 which corresponds to the initiation of the signal from seismic source 77. The position of the next pulse 91 or 92 is spaced in time from the generated pulse $T_0$ by an amount $T_1$ or $T_2$. If, for example, cart 10 is receiving pulses from rays 78*b* or 78*c* which represent positions of misalignment of the cart 10, the pulse position will be somewhat between $T_1$ and $T_2$, depending upon the misalignment amount. When cart 10 is aligned, the pulse 91 will be the minimum distance $T_1$ from $T_0$.

OPERATION OF CART AND DETECTOR APPARATUS

To understand the operation of cart 10 and the operation of detector 56 reference should be made to FIGS. 1–3 with particular reference to FIGS. 1 and 3.

Cart 10 can be moved into or out of hole 70 by transmitting a signal to antenna 65 which communicates through wire 66 to a receiver and control unit in box 63. The communicated instructions will (if necessary) energize wires 67 to motor 60 which drives gears 61 and axle 12 in the proper direction to move wheels 14 either in the forward or reverse direction. If cart 10 rides up the side of hole 70 as indicated by the dotted line 100 in FIG. 3, the weight 30 will swing in the direction of arrow 101 causing the linkage 33 to pivot at 41 and 40 which will turn wheel 15 counterclockwise. The direction of movement will cause cart 10 to steer back toward the lower portion of hole 70. Movement of the cart up the opposite side of hole 70 will cause weight 30 to rotate about shaft 20 in the direction of arrow 105 and result in the reverse movement of linkage 33. Wheel 15 will move clockwise, again sterring cart 10 to the bottom of hole 70.

It is important that the detector apparatus be positioned against the side of hole 70 so that it has a repeatable coupling with the wall. Without a repeatable coupling, the shape and position of pulse 91 or 92 (see FIG. 4) will change. To provide the repeatable coupling, detector 56 is always positioned a fixed distance from the wall of hole 70. To accomplish this, the detector is mounted on movable rack or arm 47. When the cart 10 is in position, motor 48 is activated in a manner to rotate gear 50 so that teeth 51 cause the arm 48 to move toward wall 70. The arm 47 will continue to move until switch arm 59 strikes the wall of hole 70 and depresses the switch 58 cutting off motor 48. When cutoff occurs, the detector has reached a fixed distance $d_1$ from the wall. A fixed distance will create a constant coupling of detector 56 with the wall. During the movement of cart 10 along the axis 81 of hole 70, the detector 56 can be retracted or it can remain as illustrated in FIG. 3, depending upon the smoothness of the wall surface.

In the drawings the wheels are illustrated as being mounted parallel to each other. They could also be mounted so that the rotational axis of the wheels is perpendicular to a radial passing through the tire contact point on the wall surface.

One advantage of the apparatus above-described is that the detector 56 will always remain air-coupled to the borehole wall. This affords several distinct advantages over the prior art detectors which couple directly to the borehole wall. For example, as long as the detector is air-coupled the pulse shape will be substantially similar for each reading. Secondly, any waves traveling longitudinally along the borehole wall will not be coupled into the detector 56 to an extent sufficient to mask the signals 78*a*, 78*b* or 78*c*. When dealing with extremely short distances, this last feature can be extremely important since strong signals along the borehole wall could easily mask the signal desired to be received. When measuring short distances, it is also extremely important to make certain that the distances between detector 56 and the borehole wall is exact or as near so as can be accomplished since varying the distance will vary the travel time measured and result in a substantial error. It is obvious of course where the distance between the boreholes is great compared to their diameter that the spacing between the detector and the borehole wall is not critical.

Referring to FIG. 6, a modification of the previous apparatus is illustrated. It basically differs in that a plurality of detectors 56*a* through d for example are attached to a boom 109 which in turn is attached to support tube 46. A transmitter 111 may also be attached to shaft 20 in a manner similar to support tube 46 by a support tube 110. It may also be moved by a motor utilizing a gear and rack system substantially identical to that of the detector 55. The transmitter 110 will normally be moved where it is in actual engagement with the borehole wall. A signal may then be transmitted into the borehole wall as illustrated by rays 112 and reflected along rays 113 to the receiving apparatus 55.

In operation the receiving apparatus illustrated incorporates a plurality of detectors 56*a* through *d*. It could obviously disclose a single detector as previously described. However, one advantage of a plurality of detectors is that the exact alignment of the apparatus is not as critical as the single detector. Outputs from all of the detectors can be compared in the manner illustrated in FIG. 5 and the detector showing the least time between the initiation of the signal $T_0$ and the received pulses $T_1$ will be the detector used to determine the distance. It is also obvious that if the return signal arrives between detectors that a curve could be drawn and the exact distance calculated from the curve. The illustrated device of FIG. 6 is used with a transmitter 111. It is also obvious that it could be used in the same manner as that described in FIGS. 1 through 5.

It is obvious that modifications and changes can be made to the invention and still be within the spirit and scope of the invention as disclosed in the specification and appended claims.

The embodiments of the invention in which an exclusive property or privilege is claimed are defined as follows:

1. A method for forming the axis of a borehole substantially parallel to the axis of a borehole that has already been formed comprising:

a. inserting a seismic signal generating source into one of said boreholes at a location along its axis;
b. inserting into said remaining borehole a seismic signal detecting means connected to a signal observation means;
c. spacing said detecting means away from said borehole wall so that said detecting means receives only the air wave position of said generated seismic signal;
d. operating said seismic signal source to generate a seismic signal in said borehole; and e. positioning said detecting means opposite said seismic signal generating source by observance of the seismic wave received by said detecting means;

whereby the thickness of the material between said seismic signal source and said detector can be calculated.

2. A method as described in claim 1 wherein the spacing of said detecting means is maintained a constant distance from said borehole wall.

3. An apparatus for detecting a seismic signal in a borehole having a borehole wall comprising a frame, means attached to said frame for moving said frame axially along said borehole; detecting means; means for attaching said detecting means to said frame; means for moving said detecting means toward said borehole wall for detecting said seismic signal, and away from said wall after said seismic signal detection is completed; means for spacing said detecting means a predetermined distance from said borehole wall, wherein said means for spacing said detecting means comprises a microswitch attached to said means for attaching said detecting means to said frame, and mounting in a manner to engage said borehole wall before said detecting means engages said borehole wall.

4. An apparatus as described in claim 3 wherein said means for attaching said detecting means to said frame comprises a shaft rotatably mounted parallel to the axis of movement of said frame, pendulum means attached to said shaft in a manner to rotate said shaft around its axis and means for attaching said shaft and said pendulum means to said detecting means.

5. An apparatus as described in claim 3 wherein said detecting means comprises a plurality of horizontally spaced detectors.

6. An apparatus as described in claim 4 wherein said means for moving said frame includes a front wheel and a pair of back wheels and wherein said back wheels are rotatably attached to said frame and position to support said frame away from said borehole wall and wherein said front wheel is pivotally attached to a yoke means, and steering means coupled between said pendulum means and said front wheel whereby when said cart moves up the side of said borehole wall the pendulum means through said steering means will cause said front wheel to steer said frame back to the bottom said borehole.

7. Apparatus for detecting a seismic signal in a borehole having a longitudinal axis, a side wall and a bottom wall, comprising a frame, rear wheels journaled to said frame and positioned to support said frame away from said bottom wall, a front wheel attached through a yoke to said frame, shaft means journaled in said frame and axially aligned with the axis of said borehole, detecting means attached to said shaft means and having a gear means for moving said detecting means normal to the axis of said shaft means, means attached to said frame and coupled to said gear means for selectively moving said detecting means along the axis normal to said shaft means, pendulum means attached to said shaft means for maintaining said detecting means in a substantially horizontal position with respect to the bottom wall of said borehole, means attached to said detecting means for positioning said detecting means a selected distance from the side wall of said borehole and means attached to said frame for moving said detecting means along the axis of said borehole.

8. An apparatus for determining the distance between a borehole and an acoustic continuity comprising a frame, means attached to said frame for moving said frame axially along said borehole; detecting means; means for attaching said detecting means to said frame; means for moving said detecting means toward said borehole wall; means for spacing said detecting means a predetermined distance from said borehole wall; transmitting means; and means for moving said transmitting means in engagement with said borehole wall.

9. An apparatus as described in claim 8 wherein said detecting means comprises a plurality of horizontally spaced detectors.

* * * * *